US006414451B1

(12) United States Patent
Baake et al.

(10) Patent No.: US 6,414,451 B1
(45) Date of Patent: Jul. 2, 2002

(54) HIGH-PRESSURE DISCHARGE LAMP

(75) Inventors: Reinhard Baake, Krombach; David Francis Lupton, Gelnhausen, both of (DE)

(73) Assignee: W. C. Heraeus Holding GmbH & Co. KG, Hanau (DE)

( * ) Notice: Subject to any disclaimer, the term of this patent is extended or adjusted under 35 U.S.C. 154(b) by 0 days.

(21) Appl. No.: 09/787,649

(22) PCT Filed: Jun. 21, 2000

(86) PCT No.: PCT/EP00/05695

§ 371 (c)(1),
(2), (4) Date: Mar. 20, 2001

(87) PCT Pub. No.: WO01/36541

PCT Pub. Date: Jan. 25, 2001

(30) Foreign Application Priority Data

Jul. 20, 1999 (DE) ..... 199 33 154

(51) Int. Cl.[7] ..... H01J 11/04
(52) U.S. Cl. ..... 315/358; 313/332; 313/623
(58) Field of Search ..... 315/358, 56, 326; 313/623, 624, 625, 626, 331, 332

(56) References Cited

U.S. PATENT DOCUMENTS

| | | | | |
|---|---|---|---|---|
| 4,221,987 A | | 9/1980 | Kerekes | 313/42 |
| 5,304,892 A | * | 4/1994 | Lewandowski et al. | 313/623 |
| 5,404,077 A | * | 4/1995 | Eichelbronner et al. | 313/623 |
| 5,404,078 A | | 4/1995 | Bunk et al. | 313/623 |
| 5,424,609 A | | 6/1995 | Geven et al. | 313/623 |
| 5,532,552 A | | 7/1996 | Heider et al. | 313/623 |
| 6,169,366 B1 | * | 1/2001 | Niimi | 313/572 |

FOREIGN PATENT DOCUMENTS

| | | |
|---|---|---|
| DE | 1 197 982 | 8/1965 |
| DE | 86 28 310 | 8/1989 |
| EP | 652 587 | 5/1995 |
| EP | 930 639 | 7/1999 |
| GB | 2 178 230 | 2/1987 |
| JP | 60 081 756 | 5/1985 |
| JP | 63-136456 | 6/1988 |
| JP | 05 334 996 | 12/1993 |

OTHER PUBLICATIONS

Article entitled "Niobium Proceedings of the International Symposium" by Harry Stuart published in "A publication of The Metallurgical Society of AIME" dated Nov. 8–11, 1981, pp. 613–636.

* cited by examiner

*Primary Examiner*—Don Wong
*Assistant Examiner*—Thuy Vinh Tran
(74) *Attorney, Agent, or Firm*—Cohen, Pontani, Lieberman & Pavane

(57) ABSTRACT

A discharge lamp having a discharge vessel through whose wall at least one current feedthrough is guided. A discharge electrode is arranged on one end of the current feedthrough. The current feedthrough is made of at least two separate parts and at least one part is made of niobium, tantalum or alloys based on niobium and/or tantalum. The second part is made of material which is more resistant to oxidation than the first part.

28 Claims, 5 Drawing Sheets

HIGH-PRESSURE DISCHARGE LAMP

BACKGROUND OF THE INVENTION

The invention relates to a high-pressure discharge lamp having a ceramic discharge vessel through whose wall at least one electrical feedthrough is guided, the electrical feedthrough and the discharge vessel being connected in a gas-tight fashion by means of a sealing compound, the electrical feedthrough being formed from a first individual part made from niobium, tantalum or from an alloy based on niobium and/or tantalum and from at least one second individual part, which is made from a material which is more resistant to oxidation than niobium, tantalum or an alloy based on niobium and/or tantalum. The region of the connection between the first and the second individual parts is either covered by the sealing compound or formed by the sealing compound, and a discharge electrode is arranged at one end, arranged in the discharge vessel, of the electrical feedthrough.

Such a lamp is disclosed in the German Utility Model Application G 86 28 310, niobium being used in conjunction with tungsten, a material which is more resistant to oxidation, as electrical feedthrough for high-pressure discharge lamps. Use is made in this case of a gas-tight seal and an arrangement of very complex design, in order to protect the niobium against corrosion by aggressive metal halides in the discharge vessel. The tungsten projects into the discharge vessel in this case, while the niobium projects from the discharge vessel. The niobium outside the discharge vessel is unprotected against oxidative attack. It is therefore assumed that the discharge vessel must be operated in a fashion insulated from the atmosphere in an outer protective capsule not illustrated here.

EP 930 639 A1 discloses a lamp in which an electrical feedthrough made from a glass-tantalum mixture is used together with a quartz glass vessel, the concentration of the tantalum changing along the electrical feedthrough.

Fusing occurs between the electrical feedthrough and quartz glass vessel only in a region in which the content of tantalum in the $SiO_2$ is less than 2 vol %. The end of the electrical feedthrough, which contains a high proportion of tantalum, projects in this case out of the quartz glass vessel and is only partially coated with an anti-oxidation layer made from glass, metal oxide or noble metal.

Again, components made from niobium are used in GB 2 178 230 A as electrical feedthroughs for a discharge lamp. The use of such a discharge lamp in a temperature range of 200–300° C., and/or in an atmosphere with a high moisture content is chiefly recommended in conjunction with an outer capsule which protects the electrical feedthroughs against oxidation and corrosion. Thus, one example shows the discharge lamp and the electrical feedthroughs inside a protective capsule made from glass which is filled with inert gas and sealed in a gas-tight fashion.

U.S. Pat. No. 5,404,078 discloses a high-pressure discharge lamp having a ceramic discharge vessel and having a metal halide filling, which is arranged in a protective vessel made from quartz glass. The ends of the ceramic discharge vessel are sealed with ceramic stoppers into each of which an electrical feedthrough with a round diameter is sintered in a gas-tight fashion. The electrical feedthroughs are designed such that the end of the electrical feedthrough which projects into the discharge vessel and is in contact with the metal halide filling is formed from corrosion-resistant tungsten, molybdenum, rhenium or from alloys of these metals. The other end of the electrical feedthroughs, which projects out of the discharge vessel and is surrounded by the protective vessel made from quartz glass, is formed, for example, from niobium, which is arranged in a fashion protected against corrosion by the metal halide filling.

The problem of the extremely low oxidation resistance of niobium and its alloys even at low temperatures starting from approximately 400° C. is known from the publication entitled "Niobium in High Temperature Applications" written by H. Inouye, which is based on the symposium held in San Francisco held on 8.11.1981 (Proceedings of the International Symposium). The metal tantalum, which is closely related to niobium, behaves in a way similar thereto. This property greatly limits the field of use of these metals and their alloys at elevated temperatures. Thus, coatings are already known which increase the resistance to oxidation. These are normally silicide or aluminide coatings, which can be applied only with a high outlay. In addition, the brittleness of these layers results in impairment of the thermal shock resistance accompanied by the formation of cracks or instances of chipping of the layer. The intended protective function of the coating is thereby lost, and the oxidation of the metal can proceed starting from the flaws in the layer.

SUMMARY OF THE INVENTION

It is the object of the present invention to provide a further possibility of increasing the resistance to oxidation and corrosion of electrical feedthroughs which are arranged in or on high-pressure discharge lamps, in particular on sodium high-pressure discharge lamps.

The problem is solved, firstly, in that the first individual part projects at least partially into the discharge vessel, and the second individual part projects at least partially out of the discharge vessel, in that the second individual part penetrates at most 50% of the thickness of the sealing compound, and in that the material which is more resistant to oxidation is a metal or a metal alloy with elements from the groups IVB and/or VIII of the periodic system (in accordance with CVS).

A great advantage of high-pressure discharge lamps with electrical feedthroughs of such configuration is that they can be operated without an additional outer protective encapsulation, for example made from glass. Thus, the external dimensions of the lamp can be of decisively smaller configuration. This is particularly important when there is little space available for the lamp at the place of use.

It is particularly preferred when the elements Ti and/or Pt and/or Pd and/or Ni and/or Fe and/or Ir are contained in the metal which is more resistant to oxidation and/or in the metal alloy which is more resistant to oxidation. It has proved to be particularly useful when the first individual part is formed from niobium and the second individual part is formed from titanium.

The following table is intended to illustrate purely by way of example the increased resistance to oxidation of the materials listed above by contrast with niobium, tantalum, or alloys based on niobium and/or tantalum. Titanium and niobium alloy NbZr1 were selected as reference materials:

TABLE 1

Increase in weight of titanium and NbZrl in (%) as a function of the storage time in air at elevated temperatures
(— signifies: no measurement carried out)

| Temperature | 400° C. | | 500° C. | | 600° C. | | 650° C. | | 700° C. | |
|---|---|---|---|---|---|---|---|---|---|---|
| Time | Ti | NbZrl | Ti | NbZrl | Ti | NbZrl | Ti | NbZrl | Ti | NbZrl |
| 1 h | 0 | 0.039 | 0.035 | 3.206 | 0.051 | — | 0.058 | — | 0.122 | — |
| 6 h | 0 | 3.295 | 0 | — | 0.136 | — | 0.188 | — | 0.417 | — |
| 13 h | 0 | — | 0 | — | 0.17 | — | 0.365 | — | 0.762 | — |
| 29 h | 0 | — | 0 | — | 0.356 | — | 1.005 | — | 1.188 | — |
| 69 h | — | — | — | — | 0.285 | — | — | — | — | — |
| 100 h | — | — | — | — | 0.392 | — | — | — | — | — |

The problem is solved, furthermore, by virtue of the fact that the first individual part projects at least partially into the discharge vessel, and the second individual part projects at least partially out of the discharge vessel, in that the second individual part penetrates at most 50% of the thickness of the sealing compound, and in that the material which is more resistant to oxidation is made from a ceramic. Particular preference is given here to ceramic made from $Al_2O_3$ and/or $MoSi_2$ and/or $(Mo, W)Si_2$ and/or SiC and/or $Si_3N_4$. It is also greatly advantageous here that a lamp having electrical feedthroughs of such configuration can be operated without additional outer protective encapsulation, for example made from glass, and so the external dimensions are small.

The electrical feedthrough can be designed at least partially in the form of a cylinder and/or a tubelet. One preferred embodiment is an electrical feedthrough for discharge lamps which as first individual part has a cylinder and/or a tubelet made from niobium, tantalum or from alloys based on niobium and/or tantalum, one end of this first individual part being connected in a gas-tight and electrically conducting fashion to a second individual part made from metal which is more resistant to oxidation and/or a metal alloy which is more resistant to oxidation, and the second individual part having the form of a protective cap.

It is also advantageous for the discharge lamp when the electrical feedthrough has as first individual part a cylinder and/or a tubelet made from niobium, tantalum or from alloys based on niobium and/or tantalum, and when one end of this first individual part is connected in a gas-tight fashion to a second individual part made from a metal which is more resistant to oxidation and/or from a metal alloy which is more resistant to oxidation, and when the second individual part is connected in a gas-tight fashion to a third individual part which is formed from an electrically conducting material, and when the second and the third individual parts are designed jointly as a protective cap. In this case, the first individual part can be connected in an electrically conducting fashion to the second and the third individual parts, or only to the third individual part.

A further embodiment of the discharge lamp is formed by virtue of the fact that the electrical feedthrough has as first individual part a cylinder and/or a tubelet made from niobium, tantalum or from alloys based on niobium and/or tantalum, and that one end of this first individual part is connected in a gas-tight fashion to a second individual part made from ceramic, and that the second individual part is connected in a gas-tight fashion to a third individual part which is formed from an electrically conducting material, and that the second and the third individual parts are designed jointly as a protective cap. Here, the first individual part can also be connected in an electrically conducting fashion only to the third individual part.

The third individual part can be designed as a washer or cap or stopper, or be formed from a shapeless, hardenable compound. The electrically conducting material of the third individual part can be formed entirely or partially from Cu and/or Ag. However, it is also possible that the electrically conducting material of the third individual part is formed entirely or partially from the same material as the second individual part.

The individual parts can be connected, for example, by welding and/or soldering and/or pinching and/or screwing and/or bonding and/or adhesion. Thus, gas-tight, electrically nonconducting connections are ideally constructed between two individual parts by soldering with a glass solder. Pinching of the two individual parts, carried out after the soldering, for example, produces the electrically conducting connection between the two. The particularly advantageous refinements, already described above, of the discharge lamp according to the invention have an electrical feedthrough having two or even three individual parts, and are ideally produced such that the first and the second individual parts are connected by soldering and/or pinching and/or welding, and that the second and the third individual parts are connected by adhesion.

It is particularly advantageous when the material which is more resistant to oxidation has a melting point greater than 1200° C. and a coefficient of expansion less than or equal to $10 \cdot 10^{-6} K^{-1}$.

The described high-pressure discharge lamp according to the invention is suitable, in particular, in conjunction with a sodium filling in the discharge vessel, since a sodium filling attacks the part projecting into the discharge vessel and made from niobium, tantalum or an alloy based on niobium or tantalum in a less corrosive fashion than a metal halide filling.

BRIEF DESCRIPTION OF THE DRAWINGS

The invention is now to be explained in more detail with the aid of FIGS. 1 to 5, in which.

DETAILED DESCRIPTION OF THE PREFERRED EMBODIMENTS

Figure 1:
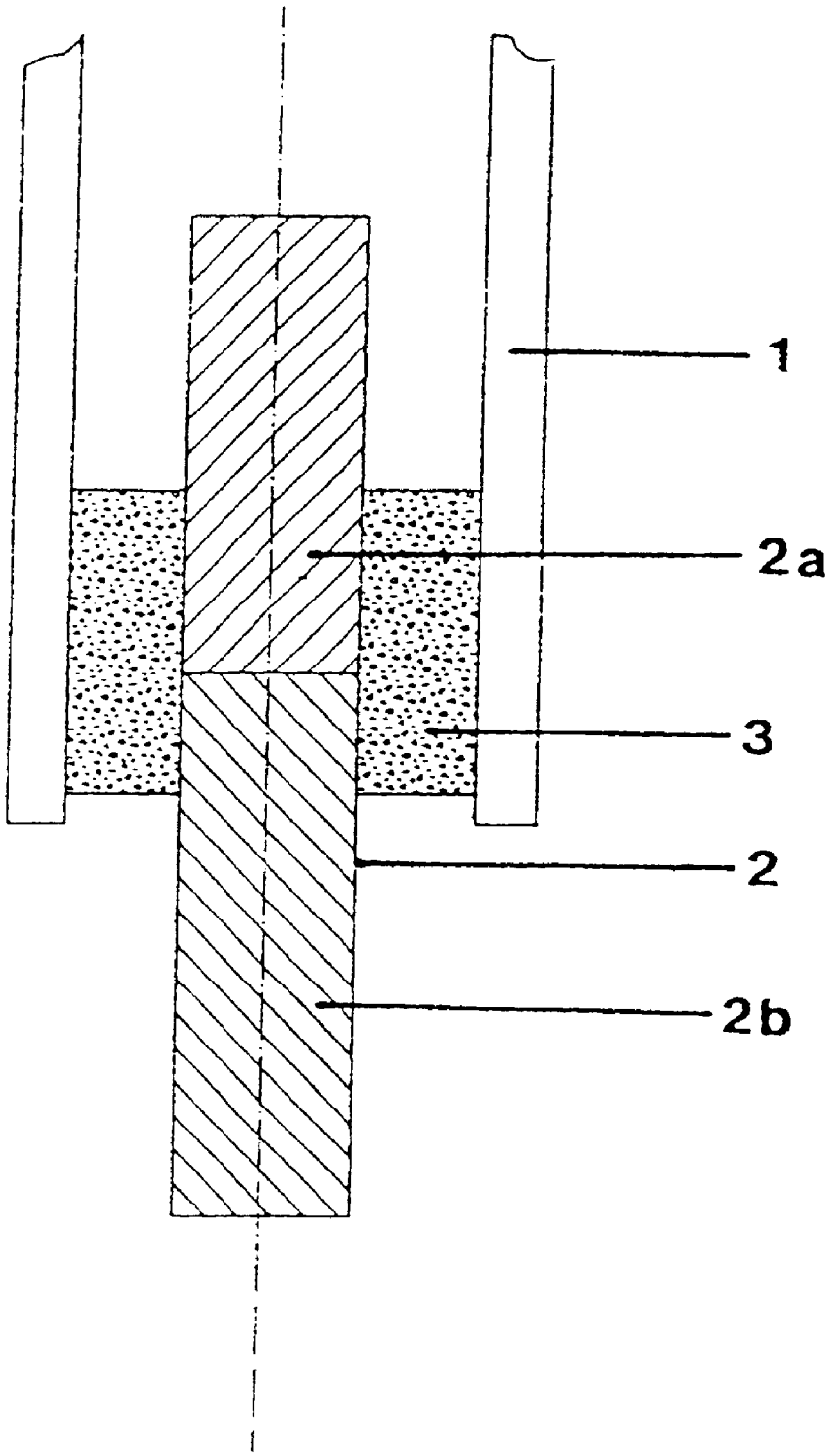
FIG. 1 shows a discharge lamp having an electrical feedthrough made from two cylindrical individual parts.

FIG. 1 shows one of the two ends of a tubular discharge vessel 1 of a discharge lamp, and an electrical feedthrough 2. The discharge vessel 1 is produced from $Al_2O_3$ in this case. The end of the discharge vessel 1 and the electrical feedthrough 2 are soldered in a gas-tight fashion with a glass solder 3. The electrical feedthrough 2 comprises a first cylindrical individual part 2*a*, for example made from the niobium alloy NbZr1, and a second cylindrical individual part 2*b*, for example made from titanium. The individual parts 2*a* and 2*b* are welded to one another in an electrically conducting fashion here. The transition region between the two individual parts 2*a* and 2*b* is covered by the glass solder 3. The second individual part 2*b* therefore projects out of the discharge vessel and is in direct contact with the ambient air, while the first individual part 2*a*, made from NbZr1, projects into the discharge vessel 1 and is therefore, in a fashion protected against oxidation, not exposed to any direct contact with the ambient air.

Figure 2:
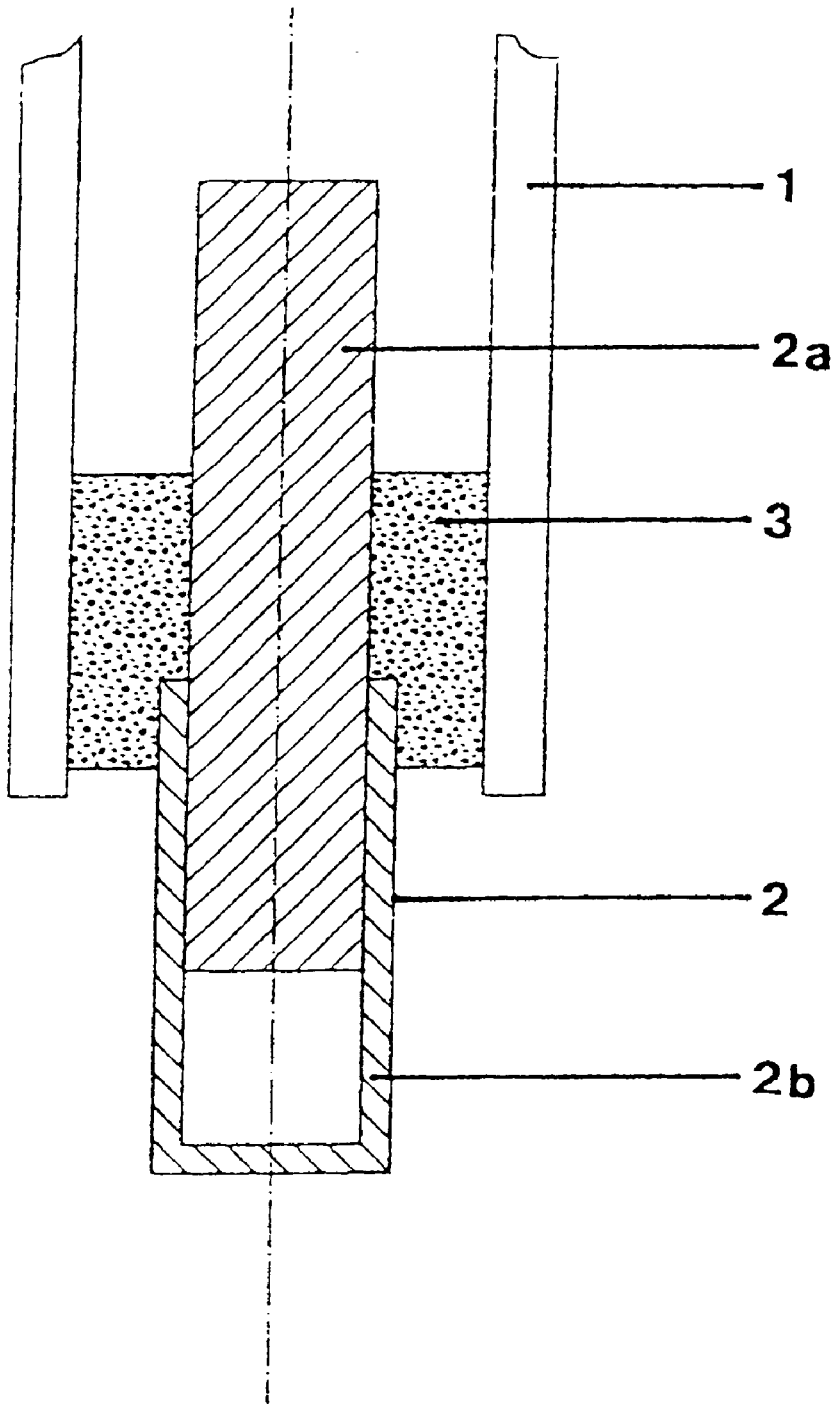
FIG. 2 shows a discharge lamp having an electrical feedthrough made from a first cylindrical individual part and a second individual part in the form of a tubelet and closed at one end.

FIG. 2 shows, as already shown in FIG. 1, one of the two ends of a tubular $Al_2O_3$ discharge vessel 1 of a discharge lamp, and an electrical feedthrough 2. The end of the discharge vessel 1 and the electrical feedthrough 2 are soldered in a gas-tight fashion with a glass solder 3. The electrical feedthrough 2 comprises a first, cylindrical individual part 2*a*, for example made from the niobium alloy NbZr1, and a second individual part 2*b*, in the form of a tubelet, made from titanium, for example. The individual part 2*b* in the form of a tubelet is closed at one end. The individual parts 2*a* and 2*b* have been connected electrically here by pinching. The transition region between the two individual parts 2*a* and 2*b* is covered by the glass solder 3 and soldered in a gas-tight fashion. The second individual part 2*b* therefore projects out of the discharge vessel and makes direct contact with the ambient air, while the first individual part 2*a*, made from NbZr1, projects into the discharge vessel 1 and the second individual part 2*b*, in the form of a tubelet and closed at one end, and is therefore, in a fashion protected against oxidation, not exposed to any direct contact with the ambient air.

Figure 3:
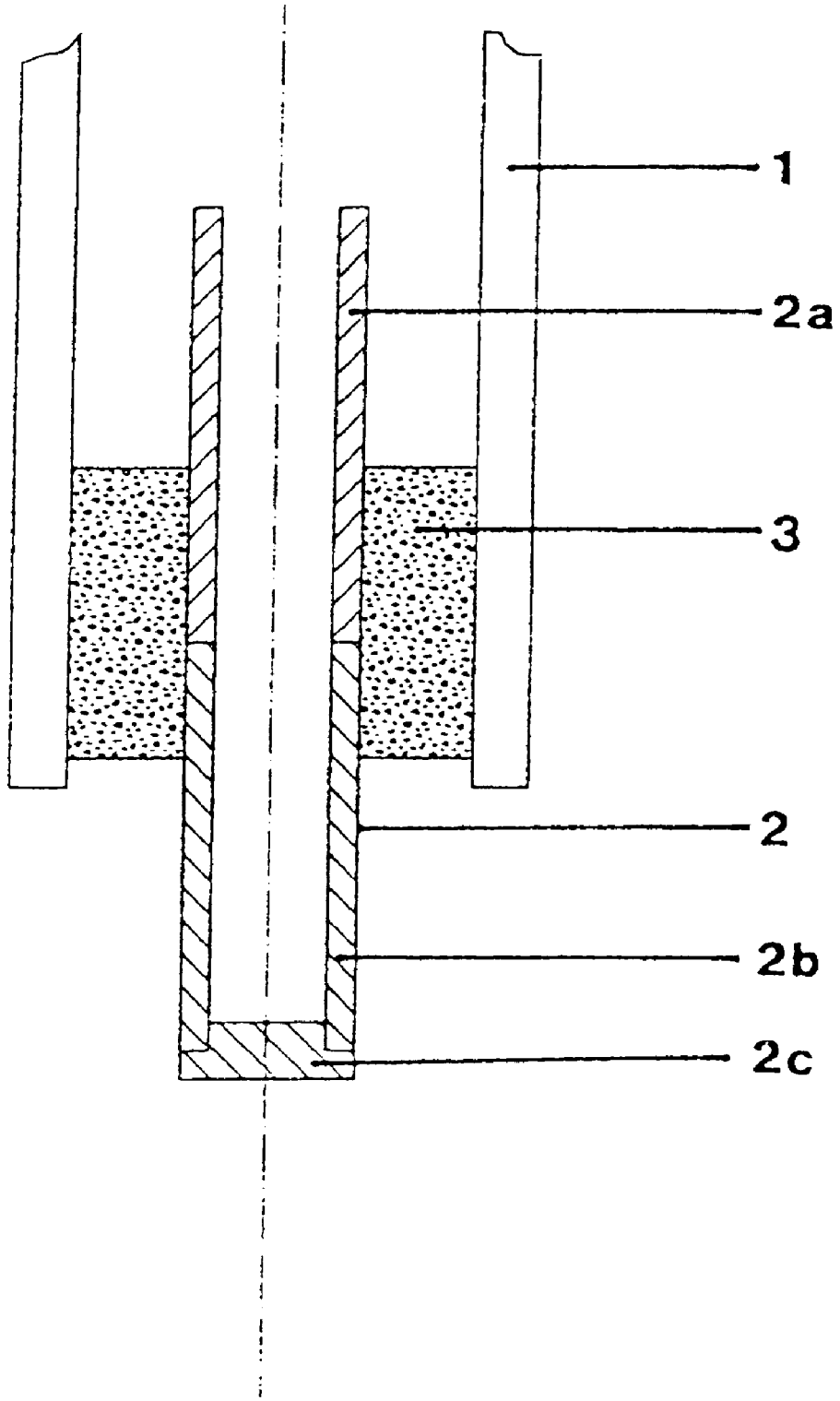
FIG. 3 shows a discharge lamp having an electrical feedthrough made from two individual parts in the form of tubelets and a third individual part in the form of a stopper.

FIG. 3 also shows one of the two tubular ends of an $Al_2O_3$ discharge vessel 1 of a discharge lamp, and an electrical feedthrough 2. The end of the discharge vessel 1 and the electrical feedthrough 2 are soldered in a gas-tight fashion by a glass solder 3. The electrical feedthrough 2 comprises a first individual part 2*a* in the form of a tubelet, for example made from the niobium alloy NbZr1, and a second individual part 2*b* in the form of a tubelet, for example made from titanium. The individual part 2*b* in the form of a tubelet is sealed at one end with a third individual part in the form of a stopper 2*c*. The individual parts 2*a* and 2*b* are connected in an electrically conducting fashion by welding here. The transition region between the two individual parts 2*a* and 2*b* is covered by the glass solder 3. The second individual part 2*b* together with the third individual part designed as a stopper 2*c* therefore projects out of the discharge vessel and makes direct contact with the ambient air, while the first individual part 2*a*, made from NbZr1, projects into the discharge vessel 1 and is therefore, in a fashion protected against oxidation, not exposed to any direct contact with the ambient air. The electrically conducting connection between the second individual part 2*b* and the third individual part, designed as a stopper 2*c*, can be selected depending on the temperature loading and is connected by adhesion here, by way of example. The material for the third individual part in the form of a stopper 2*c* is silver, for example.

Figure 4:
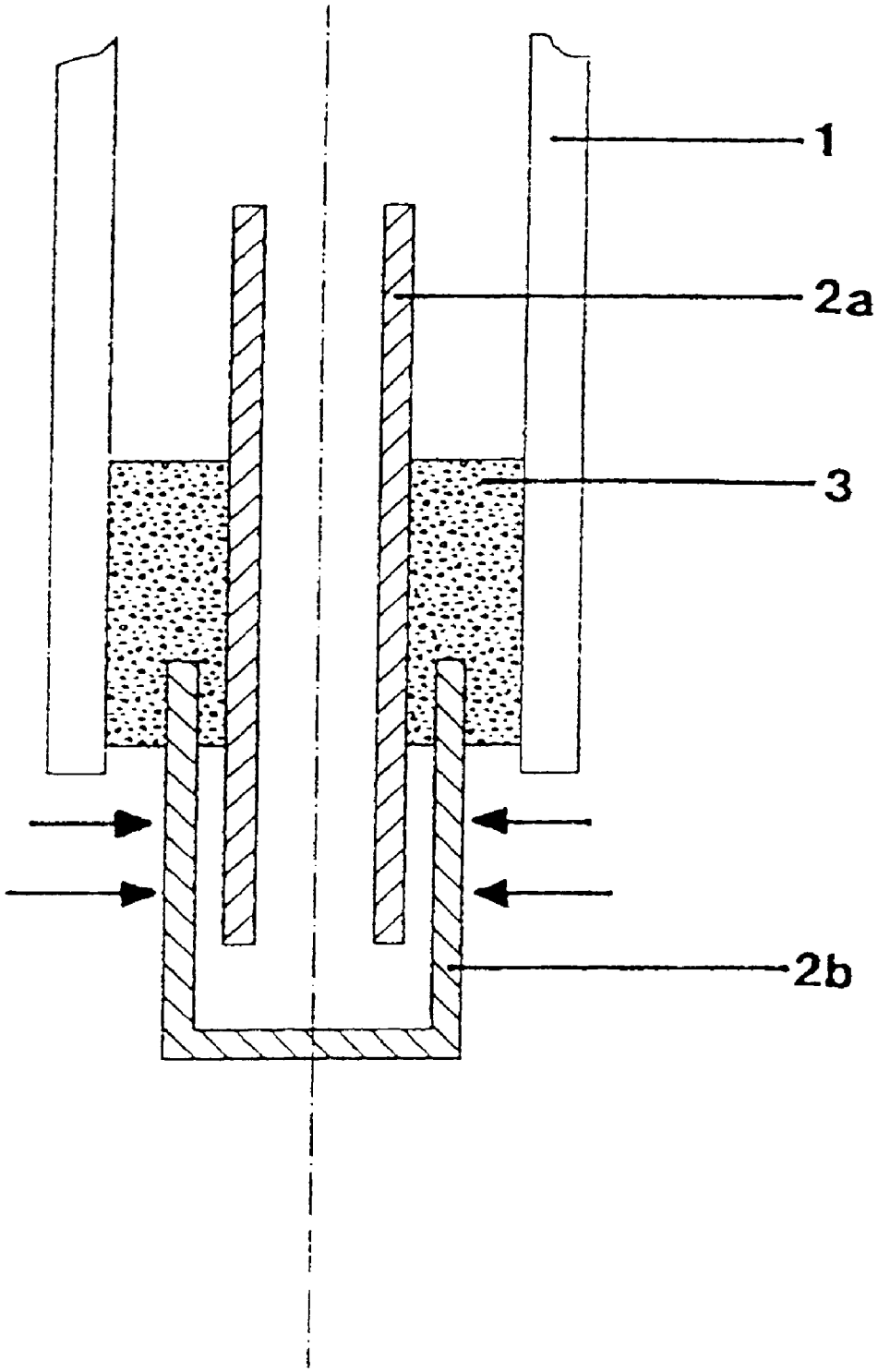
FIG. 4 shows a discharge lamp with an electrical feedthrough made from a first individual part in the form of a tubelet and a second individual part in the form of a tubelet and sealed at one end.

FIG. 4 likewise shows one of the two ends of a tubular $Al_2O_3$ discharge vessel 1 of a discharge lamp, and an electrical feedthrough 2*a*; 2*b*. The end of the discharge vessel 1 and the electrical feedthrough 2*a*; 2*b* are soldered in a gas-tight fashion by a glass solder 3. The electrical feedthrough 2*a*; 2*b* comprises a first individual part 2*a* in the form of a tubelet, for example made from the niobium alloy NbZr1, and a second individual part 2*b* in the form of a tubelet and closed at one end, for example made from titanium. The individual part 2*b* in the form of a tubelet and closed at one end. The individual parts 2*a* and 2*b* are connected here by soldering with the glass solder 3 in a gas-tight fashion, but not electrically. The transition region between the two individual parts 2*a* and 2*b* is covered by the glass solder 3. The second individual part 2*b* therefore projects out of the discharge vessel and makes direct contact with the ambient air, while the first individual part 2*a*, made from NbZr1, projects into the discharge vessel 1 and the second individual part 2*b*, in the form of a tubelet and closed at one end, and is therefore, in a fashion protected against oxidation, not exposed to any direct contact with the ambient air. The electrically conducting connection between the second individual part 2*b* and the first individual part 2*a* is produced here by a pinched connection, indicated by the arrows, only after soldering with the glass solder 3.

Figure 5:
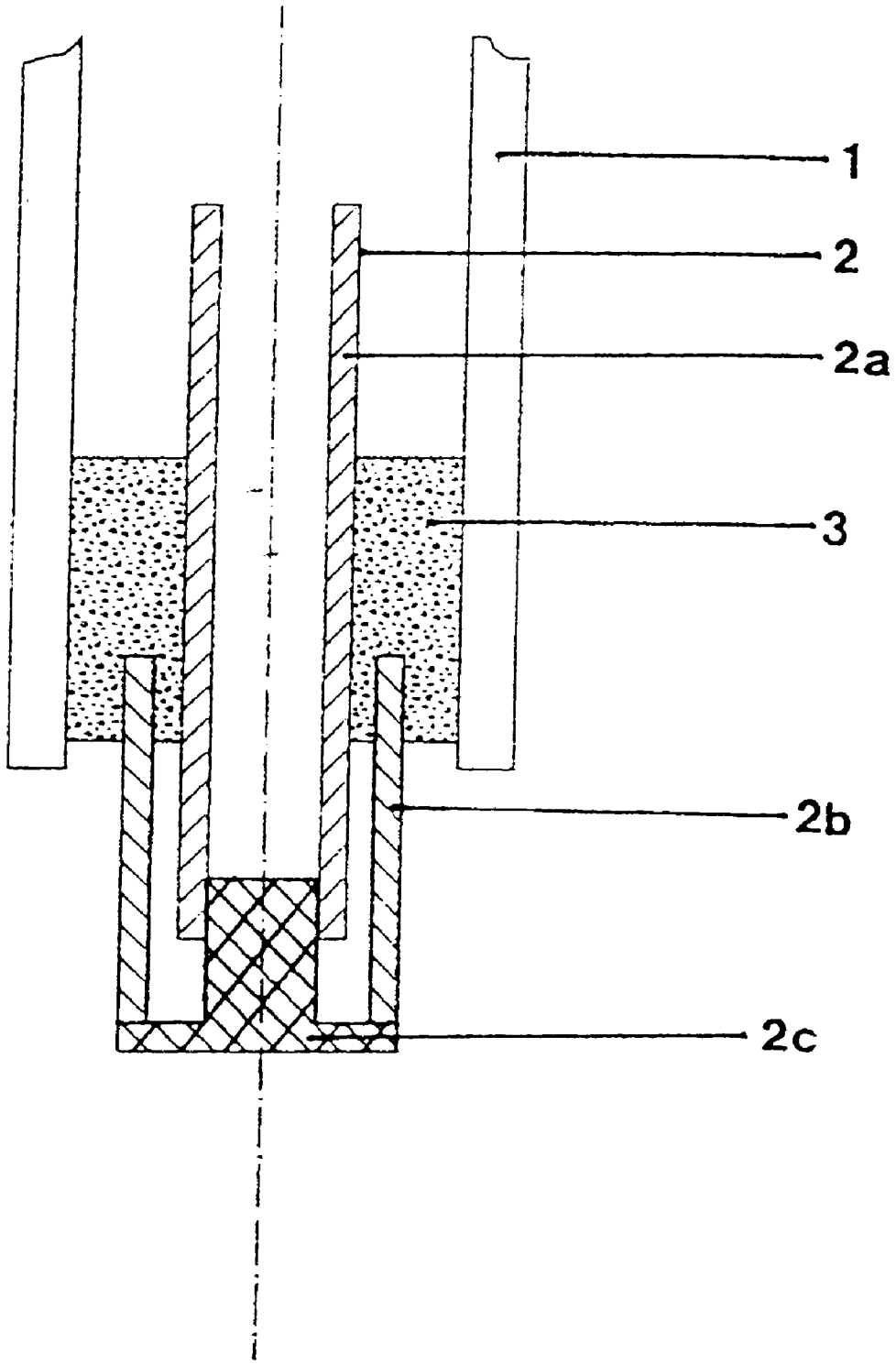
FIG. 5 shows a discharge lamp having an electrical feedthrough made from a first individual part in the form of a tubelet, and a second individual part in the form of a tubelet and a third individual part in the form of a stopper.

FIG. 5 also shows one of the two ends of a tubular $Al_2O_3$ discharge vessel 1 of a discharge lamp, and an electrical feedthrough 2. The end of the discharge vessel 1 and the electrical feedthrough 2 are soldered in a gas-tight fashion by a glass solder 3. The electrical feedthrough 2 comprises a first individual part 2*a* in the form of a tubelet, for example made from the niobium alloy NbZr1, and a second individual part 2*b* in the form of a tubelet, for example made from $Al_2O_3$. The individual part 2*b* in the form of a tubelet is closed at one end with a third individual part in the form of a stopper 2*c*. The individual parts 2*a* and 2*b* are connected here by soldering with the glass solder 3 in a gas-tight fashion, but not electrically. The transition region between the two individual parts 2*a* and 2*b* is covered by the glass solder 3. The second individual part 2*b* together with the third individual part designed as a stopper 2*c* therefore projects out of the discharge vessel and makes direct contact with the ambient air, while the first individual part 2*a*, made from NbZr1, projects into the discharge vessel 1 and is therefore, in a fashion protected against oxidation, not exposed to any direct contact with the ambient air. The electrically conducting connection between the first individual part 2*a* and the stopper 2*c*, and the gas-tight connection between the second individual part 2*b* and the third individual part 2*c* can be selected as a function of temperature loading and are connected here, for example with the aid of a conductive adhesive. The choice of material for the third individual part in the form of the stopper 2*c* can likewise be selected depending on requirement, for example from the metals of silver or titanium.

Thus, while there have been shown and described and pointed out fundamental novel features of the present invention as applied to a preferred embodiment thereof, it will be understood that various omissions and substitutions and changes in the form and details of the devices illustrated, and in their operation, may be made by those skilled in the art without departing from the spirit of the present invention. For example, it is expressly intended that all combinations of those elements and/or method steps which perform substantially the same function in substantially the same way to achieve the same results are within the scope of the invention. Substitutions of elements from one described embodiment to another are also fully intended and contemplated. It is also to be understood that the drawings are not necessarily drawn to scale but that they are merely conceptual in nature. It is the intention, therefore, to be limited only as indicated by the scope of the claims appended hereto.

What is claimed is:

1. A high-pressure discharge lamp, comprising:

a ceramic discharge vessel having a wall;

an electrical feedthrough guided through the wall of the discharge vessel so that a first part projects at least partially into the discharge vessel and a second part projects at least partially out of the discharge vessel;

a sealing compound provided so as to connect the electrical feedthrough to the discharge vessel in a gas-tight manner, the first part of the electrical feedthrough being made from at least one of niobium, tantalum and an alloy based on at least one of niobium and tantalum, and the second part being made of a material more resistant to oxidation than the first part, the material more resistant to oxidation being one of a metal and a metal alloy with elements from at least one of the groups IVB and VIII of the periodic system, the sealing compound being arranged so as to one of cover and form a connection region between the first part and the second part the second part being arranged to penetrate at most 50% of a thickness of the sealing compound; and a discharge electrode arranged at one end of the electrical feedthrough so as to be inside the discharge vessel.

2. A high-pressure discharge lamp as defined in claim 1, wherein the material of the second part includes at least one of the elements from the group consisting to Ti, Pt, Pd, Ni, Fe and Ir.

3. A high-pressure discharge lamp as defined in claim 1, wherein the first part is made of niobium and the second part is made of titanium.

4. A high-pressure discharge lamp as defined in claim 1, wherein the electrical feedthrough is at least partially formed as at least one of a cylinder and a tubelet.

5. A high-pressure discharge lamp as defined in claim 4, wherein the first part of the electrical feedthrough is formed as at least one of a cylinder and a tubelet made of one of niobium, tantalum and alloys based on at least one of niobium and tantalum, one end of the first part being connected in a gas-tight and electrically conductive manner to the second part, the second part being formed as a protective cap.

6. A high-pressure discharge lamp as defined in claim 4, wherein the first part of the electrical feedthrough is formed as at least one of a cylinder and a tubelet made of one of niobium, tantalum and alloys based on at least one of niobium and tantalum, one end of the first part being connected in a gas-tight manner to the second part, the electrical feedthrough including a third part to which the second part is connected in a gas-tight manner, the third part being made of an electrically conducting material, the second part and the third part being configured so as to jointly form a protective cap.

7. A high-pressure discharge lamp as defined in claim 6, wherein the first part is connected in an electrically conducting fashion one of to only the third part, and to the second and the third parts.

8. A high-pressure discharge lamp as defined in claim 6, wherein the third part is formed as one of a washer, a cap and a stopper.

9. A high-pressure discharge lamp as defined in claim 6, wherein the third part is a shapeless, hardenable compound.

10. A high-pressure discharge lamp as defined in claim 6, wherein the electrically conducting material of the third part is formed at least one of Cu and Ag.

11. A high-pressure discharge lamp as defined in claim 6, wherein the electrically conducting material of the third part is formed at least partially from the same material as the second part.

12. A high-pressure discharge lamp as defined in claim 6, wherein the first and second parts are connected by at least one of soldering, pinching and welding, and the second and third parts are connected by adhesion.

13. A high-pressure discharge lamp as defined in claim 1, wherein the parts are connected by at least one of welding, soldering, pinching, screwing, bonding and adhesion.

14. A high-pressure discharge lamp as defined in claim 13, wherein the sealing compound is glass solder, the parts being pinchable so as to form an electrically conducting connection therebetween.

15. A high-pressure discharge lamp as defined in claim 1, wherein the material which is more resistant to oxidation has a melting point greater than, 1200° C. and a coefficient of expansion no more than $10 \cdot 10^{-6}$ $K^{-1}$.

16. A high-pressure discharge lamp as defined in claim 1, where in the high-pressure discharge lamp is a sodium high-pressure discharge lamp.

17. A high-pressure discharge lamp, comprising:

a ceramic discharge vessel having a wall;

an electrical feedthrough guided through the wall of the discharge vessel, so that a first part projects at least partially into the vessel and a second part projects at least partially out of the discharge vessel;

a sealing compound provided so as to connect the electrical feedthrough to the discharge vessel in a gas-tight manner, the first part of the electrical feedthrough being made from at least one of niobium, tantalum and an alloy based on at least one of niobium and tantalum, the second part being made of a material more resistant to oxidation than the first part, the material more resistant to oxidation being a ceramic, the sealing compound being arranged so as to one of cover and form a connection region between the first part and the second part the second part being arranged to penetrate at most 50% of a thickness of the sealing compound; and a discharge electrode arranged at one end of the electrical feedthrough so as to be inside the discharge vessel.

18. A high-pressure discharge lamp as defined in claim 17, wherein the material which is more resistant to oxidation is formed from a ceramic made form at least one of the group consisting of $Al_2O_3$, Mo $Si_2$, (Mo, W) $Si_2$, Si C and $Si_3$ $N_4$.

19. A high-pressure discharge lamp as defined in claim 17, wherein the electrical feedthrough is at least partially formed as at least one of a cylinder and a tubelet.

20. A high-pressure discharge lamp as defined in claim 19, wherein the first part of the electrical feedthrough is one of a cylinder and a tubelet made of one of niobium, tantalum and alloys based on one of niobium and tantalum, one end of the first part being connected in a gas-tight manner to the second part, the electrical feedthrough including a third part made of an electrical conducting material, the second part being connected in a gas-tight manner to the third part, the second part and the third part being configured so as to jointly form a protective cap.

21. A high-pressure discharge lamp as defined in claim 20, wherein the first part is connected in an electrically conducting manner to the third part.

22. A high-pressure discharge lamp as defined in claim 20, wherein the third part is one of a washer, a cap and a stopper.

23. A high-pressure discharge lamp as defined in claim 20, wherein the third part is a shapeless, hardenable compound.

24. A high-pressure discharge lamp as defined in claim 20, wherein the electrically conducting material of the third part is formed at least partially by at least one of Cu and Ag.

25. A high-pressure discharge lamp as defined in claim 20, wherein the electrically conducting material of the third part is formed at least partially from the same material as the second part.

26. A high-pressure discharge lamp as defined in claim 20, wherein the first and second parts are connected by at least one of soldering, pinching and welding, and the second and third parts are connected by adhesion.

27. A high-pressure discharge lamp as defined in claim 17, wherein the material which is more resistant to oxidation has a melting point greater than 1200° C. and a coefficient of expansion no more than $10 \cdot 10^{-6}$ $K^{-1}$.

28. A high-pressure discharge lamp as defined in claim 17, wherein the high-pressure discharge lamp is a sodium high-pressure discharge lamp.

* * * * *